US006750827B2

(12) United States Patent
Manasson et al.

(10) Patent No.: US 6,750,827 B2
(45) Date of Patent: Jun. 15, 2004

(54) DIELECTRIC WAVEGUIDE ANTENNA WITH IMPROVED INPUT WAVE COUPLER

(75) Inventors: Vladimir A. Manasson, Los Angeles, CA (US); Lev S. Sadovnik, Irvine, CA (US)

(73) Assignee: Waveband Corporation, Irvine, CA (US)

( * ) Notice: Subject to any disclaimer, the term of this patent is extended or adjusted under 35 U.S.C. 154(b) by 90 days.

(21) Appl. No.: 10/141,111

(22) Filed: May 8, 2002

(65) Prior Publication Data

US 2003/0210196 A1 Nov. 13, 2003

(51) Int. Cl.[7] ..... H01Q 13/00
(52) U.S. Cl. ..... 343/785; 343/786; 343/781 R
(58) Field of Search ..... 343/753, 755, 343/772, 775, 779, 781 R, 785, 786

(56) References Cited

U.S. PATENT DOCUMENTS 3,605,101 A * 9/1971 Kolettis et al. ..... 343/783
3,611,396 A * 10/1971 Jones, Jr. ..... 343/776
4,482,899 A * 11/1984 Dragone ..... 343/786
5,109,232 A * 4/1992 Monte ..... 343/785
5,684,495 A * 11/1997 Dyott et al. ..... 343/785
6,211,836 B1 * 4/2001 Manasson et al. ..... 343/785
6,211,842 B1 * 4/2001 Cousin et al. ..... 343/840
6,469,676 B1 * 10/2002 Fehrenbach et al. ..... 343/786

* cited by examiner

*Primary Examiner*—Tho Phan
(74) *Attorney, Agent, or Firm*—Robert Nick

(57) ABSTRACT

An improved millimeter wavelength antenna assembly having an input signal coupler, a dielectric waveguide, and a rotatable drum is disclosed. The input signal coupler reduces VSWR return losses and scattered radiation losses from the drum and matches a feeding waveguides characteristics to the dielectric waveguide. Embodiments of the invention include a reflector and a cylindrical lens to direct and form electromagnetic energy radiated by the antenna assembly.

35 Claims, 6 Drawing Sheets

DIELECTRIC WAVEGUIDE ANTENNA WITH IMPROVED INPUT WAVE COUPLER

FIELD OF THE INVENTION

The invention relates to dielectric waveguide antennas and more particularly to millimeter wavelength antennas that have a rotatable drum.

BACKGROUND OF THE INVENTION

Dielectric waveguide antennas are described in U.S. Pat. Nos. 6,211,836 and 5,959,589 issued Apr. 3, 2001 and Sep. 28, 1999 respectively and assigned to the assignee of the present application. The above-noted patents are incorporated herein by reference.

Such antennas operate by coupling electromagnetic waves out of a dielectric waveguide to a rotating drum and radiating the coupled energy in patterns determined by features on the surface of the drum.

The efficiency of these antennas depends on the VSWR and scattering losses created when inputting electromagnetic signals into the waveguide.

Accordingly, a need exists for an improved drum-type dielectric waveguide antenna that has reduced input signal coupling losses and a lower VSWR compared to prior art antennas of the rotating drum type.

BRIEF SUMMARY OF THE INVENTION

A rotatable drum dielectric rod waveguide antenna assembly with an improved input wave coupler is described.

The antenna assembly comprises an input wave coupler into which an electromagnetic wave is launched, a dielectric waveguide, and a rotating metallic drum, in close proximity to the waveguide, to control radiated electromagnetic energy between the waveguide and drum.

The input wave coupler of the invention further comprises a horn-shaped element and a metal extension for matching the characteristics of a feeding waveguide to those of the dielectric waveguide. The coupler operates to reduce VSWR return losses and scattered radiation from edges of the drum.

Additional embodiments of the invention include a reflector and a cylindrical lens to form and direct radiation out of the waveguide and drum.

DETAILED DESCRIPTION OF THE INVENTION

Figure 1:
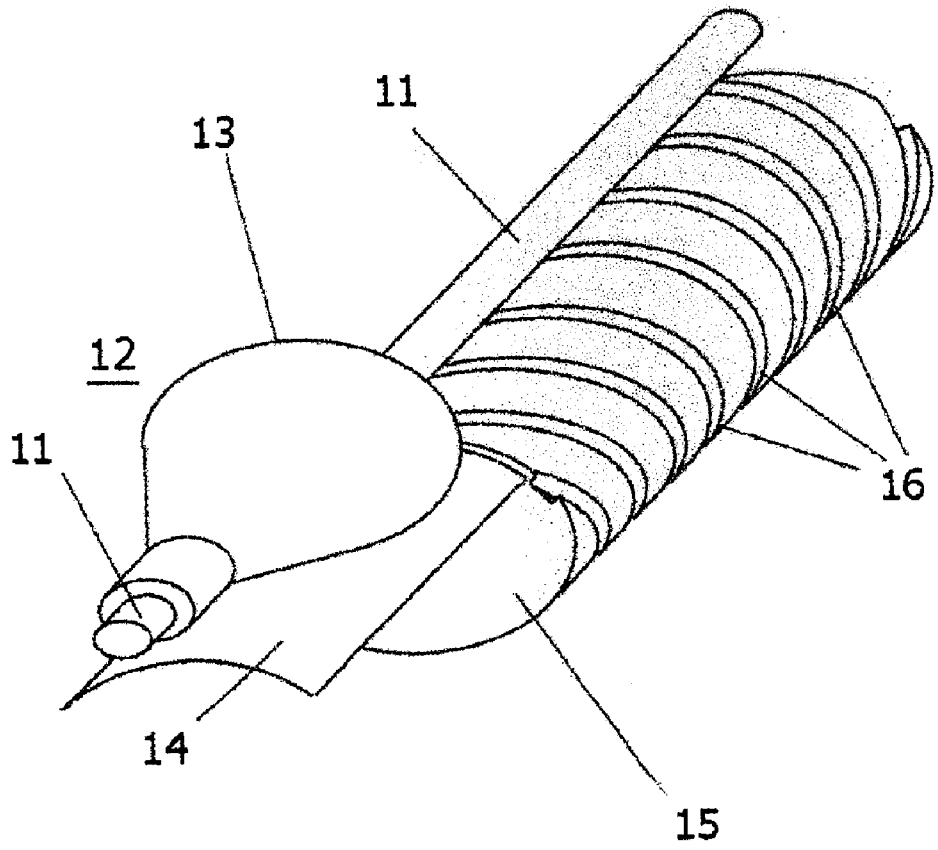
FIG. 1 is an illustrative view of an antenna assembly of the invention.

With reference to FIG. 1, a millimeter wavelength antenna 10 of the invention comprises a single mode dielectric waveguide 11, an input signal coupler 12 including a horn-shaped element 13 and metal extension 14, and a rotating metal drum 15.

The waveguide 11 is fabricated from a circular rod of dielectric material, such as quartz, Teflon, or a ceramic, with an appropriate rod diameter to conduct millimeter wavelength electromagnetic waves.

A rotating metal drum 15 is placed in close proximity with the waveguide rod 11 to couple evanescent electromagnetic waves between the drum and the rod. In addition, as described in the above referenced patents, the metal body of the drum 15 can be formed with a pattern of grooves 16, to direct the propagation of radiation from the waveguide and drum assembly.

The drum 15 is preferably cylindrical in shape but may also be conical or elliptical to produce desired beam shapes.

The horn-shaped element 13 of the input signal coupler 12 of the invention is preferably made of metal and is positioned in energy-coupled relationship with a metal extension 14 that abuts the drum 15. The waveguide rod 11 is coupled to the horn-shaped element 13 and extends through the center of the horn coaxially with and along the length of the drum 15.

In operation, the properties of the horn-shaped element are chosen so that electromagnetic characteristics of a feeding waveguide (not shown) are matched to the dielectric rod waveguide. By matching waveguide characteristics, return losses are minimized and a lower VSWR is obtained, improving overall antenna efficiency.

To reduce scattering of electromagnetic radiation from edges of the drum, the arc-shaped metal extension has a radius equal to that of the drum and extends axially outward from an edge of the drum.

Figure 2:
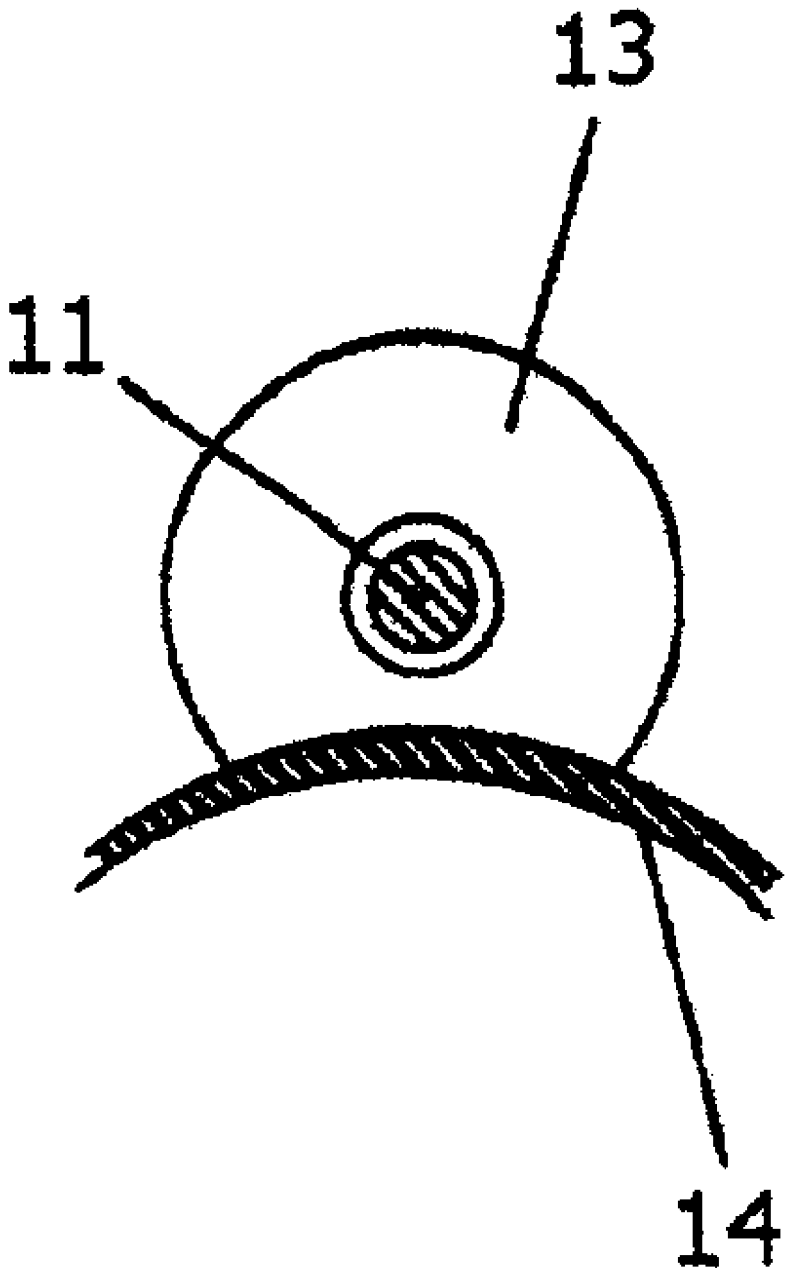
FIG. 2 is a cross-sectional view of the input wave coupler of the invention.

Improvements in antenna performance can be realized by varying the geometry of the horn-shaped element. For example, as shown in FIG. 2, an arc-shaped cutout in the horn 13, conforming to the diameter of the drum 14, can improve electromagnetic wave coupling.

Figure 3:
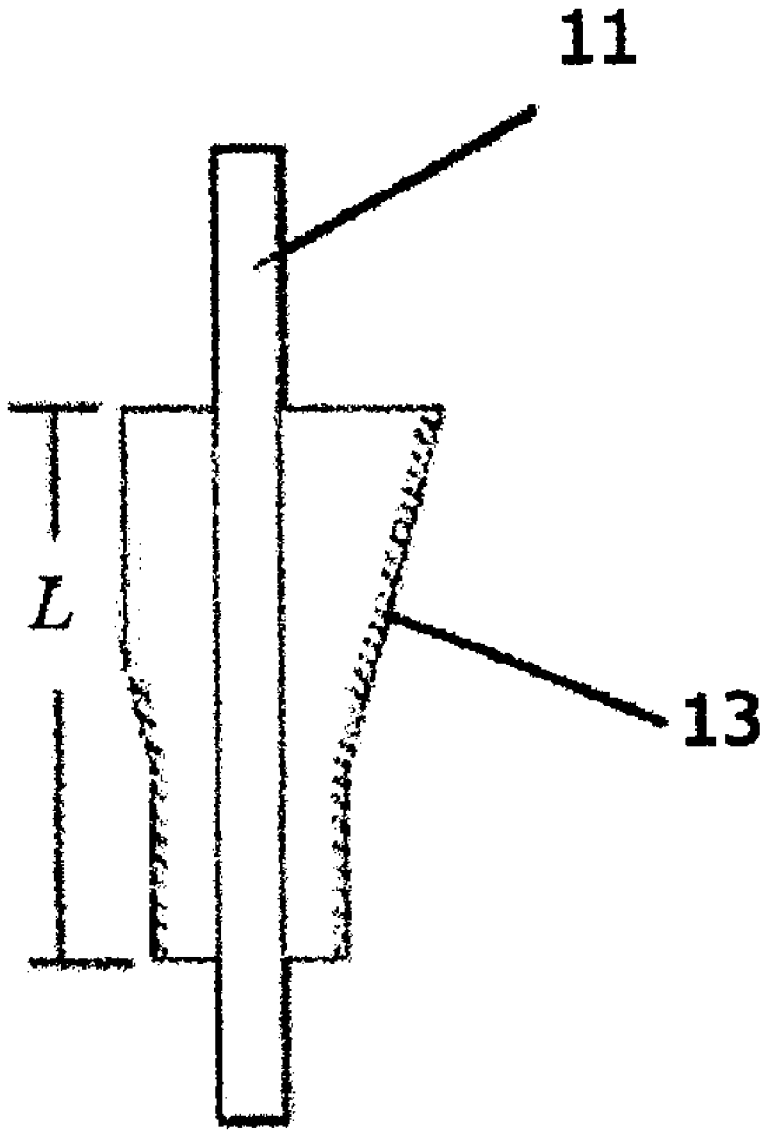
FIG. 3 is a cross-sectional view of an extended horn embodiment of the input wave coupler of the invention.

Increasing the length (L) of the horn 13, as illustrated in FIG. 3, can improve antenna efficiency by providing increased signal coupling to the dielectric waveguide 11.

Figure 4:
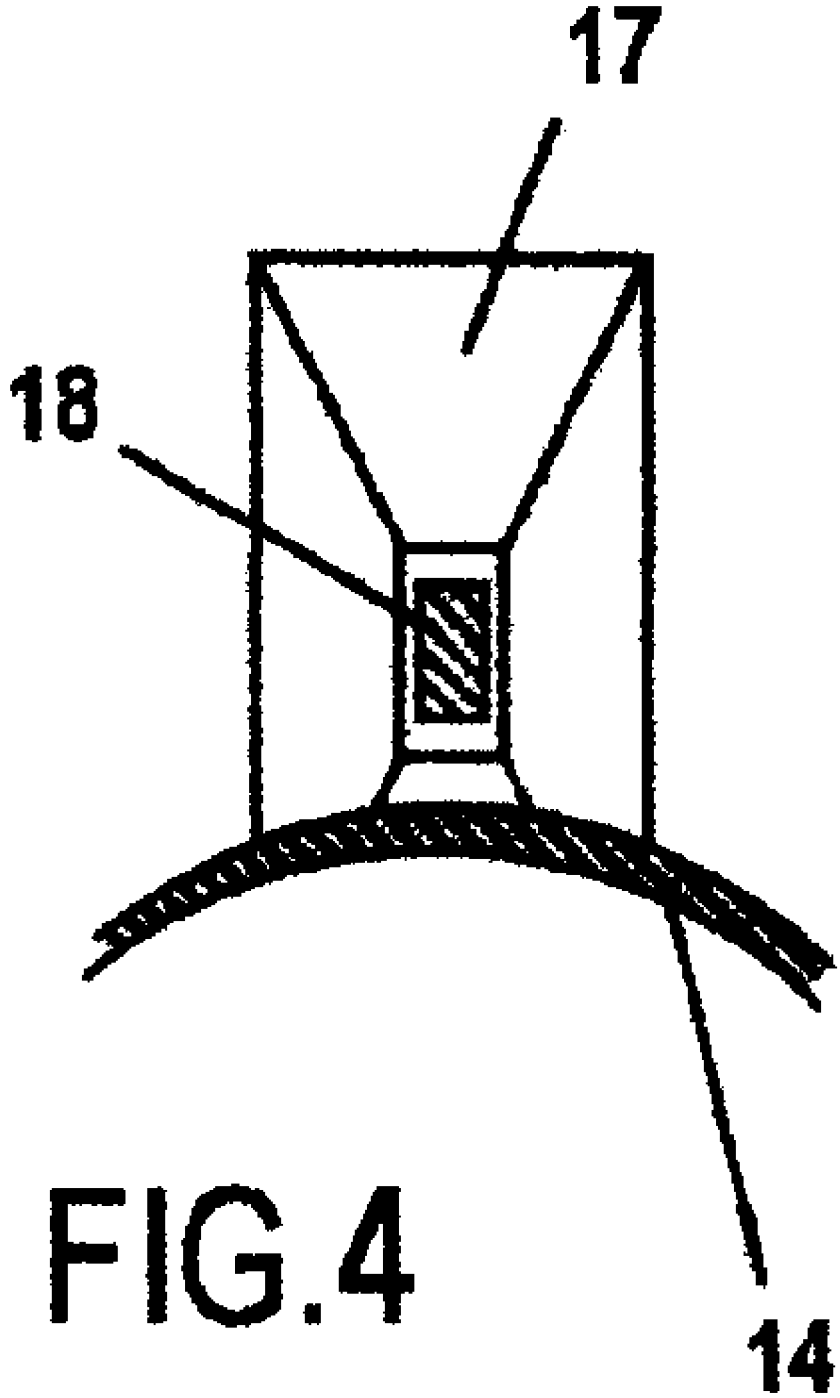
FIG. 4 is a cross-sectional view of an alternative horn embodiment of the invention.

A conical horn element and circular rod waveguide, are illustrated in FIG. 1, however other types of horn elements and waveguide shapes can be used. A funnel-shaped horn 17 and a rectangular rod waveguide 18, for example, are shown in FIG. 4.

Figure 5:
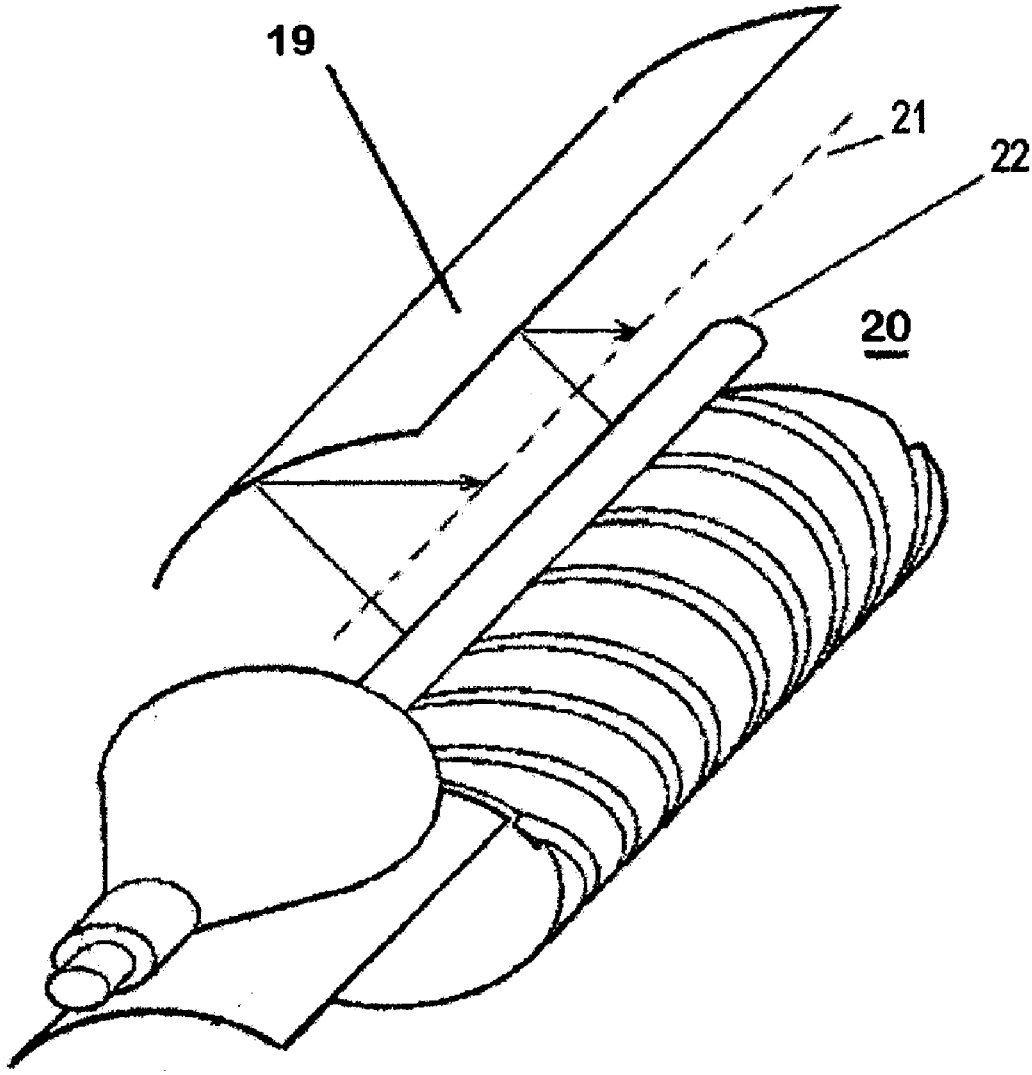
FIG. 5 is an illustrative view of an antenna assembly of the invention including a reflector.

The antenna assembly of the invention may additionally include a metallic reflector to direct energy radiated by the antenna. As shown in FIG. 5, a reflector 19, having a parabolic surface with a focus line 21 located near the waveguide 22, is oriented to direct the elevation (vertical) propagation of radiation from the waveguide and drum assembly 20. The reflector may also have a more complex surface to form the shape of the beam in the vertical plane.

Figure 6:
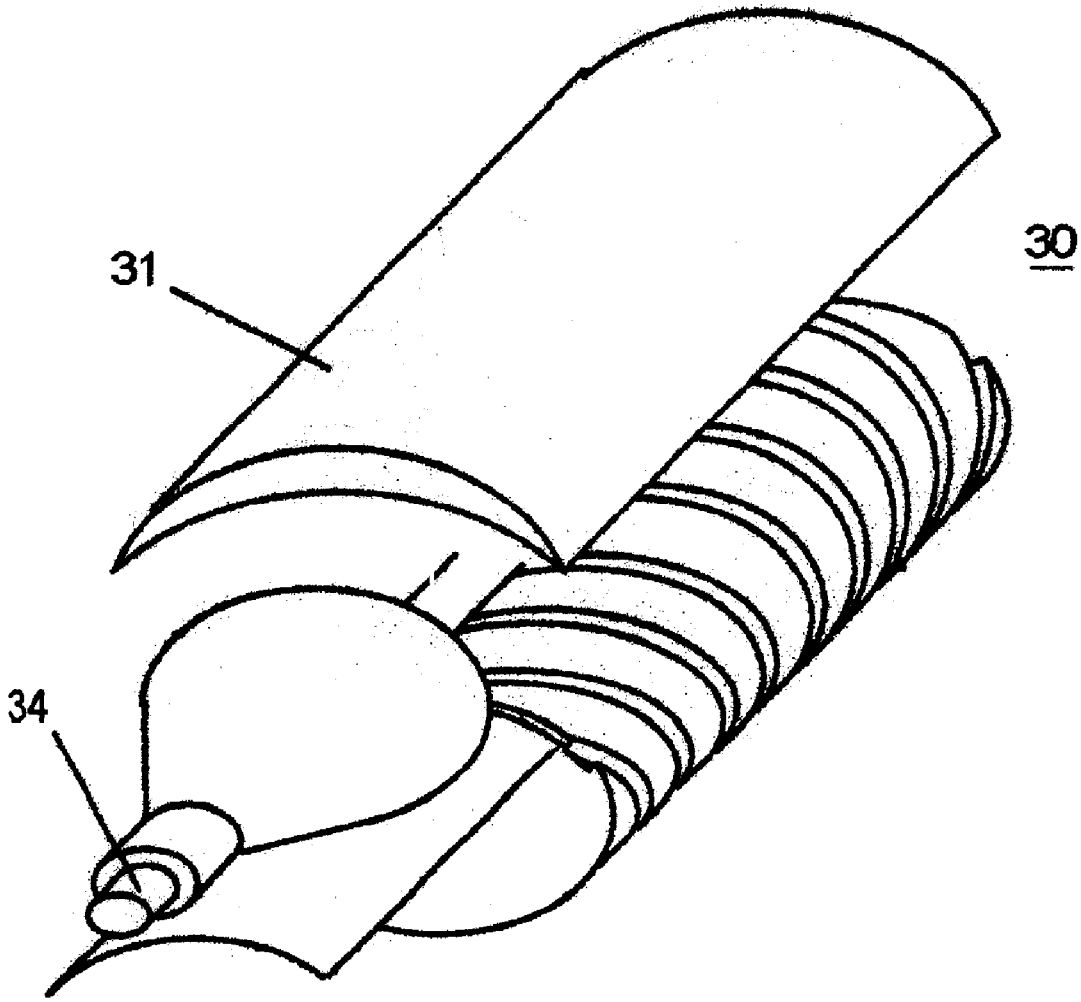
FIG. 6 is an illustrative view of an antenna assembly of the invention including a cylindrical lens.

A cylindrical lens, made of Teflon, polystyrene, or polyethylene, may be used in the antenna assembly to form the radiated beam in the vertical plane. As shown in FIG. 6, a semi-cylindrical lens 31 is positioned close to the waveguide and drum assembly 30 so that the focus line of the lens is near the waveguide rod 34. In this configuration, the lens forms the shape of the beam in the vertical plane but does not change the direction of propagation of the radiated wave. A tapered cylindrical lens may be used to alter the shape of the beam in the azimuth plane.

Although the various features of novelty that characterize the invention have been described in terms of certain preferred embodiments, other embodiments will become apparent to those of ordinary skill in the art, in view of the disclosure herein. Accordingly, the present invention is not limited by the recitation of the preferred embodiments, but is instead intended to be defined solely by reference to the appended claims.

What is claimed is:

1. A drum millimeter waveguide antenna assembly comprising:

a dielectric waveguide;

an input signal coupler for matching the electromagnetic characteristics of a feeding waveguide to said dielectric waveguide said coupler comprising a horn-shaped element having an axial opening therethrough to receive said dielectric waveguide and a metal extension in proximal relationship with said horn-shaped element;

a rotatable metal drum positioned in energy-coupled relationship with said input signal coupler whereby evanescent electromagnetic waves are coupled between said drum and said input signal coupler to direct the propagation of radiation from said antenna assembly.

2. The rotatable metal drum of claim 1 wherein the body of said drum is formed with a pattern of grooves to direct the propagation of radiation from said input signal coupler and waveguide.

3. The dielectric waveguide of claim 1 wherein said waveguide is a single-mode waveguide.

4. The dielectric waveguide of claim 1 wherein said dielectric is selected from the group consisting of ceramics, quartz and Teflon.

5. The dielectric waveguide of claim 1 wherein said waveguide is fabricated as a circular rod.

6. The dielectric waveguide of claim 1 wherein said waveguide is fabricated as a rectangular rod.

7. The dielectric waveguide of claim 1 wherein said waveguide conducts millimeter wavelength electromagnetic waves.

8. The horn-shaped element of claim 1 wherein said horn-shaped element is made of metal.

9. The horn-shaped element of claim 1 wherein said horn-shaped element is conical in shape.

10. The horn-shaped element of claim 1 wherein said horn-shaped element has a peripheral cutout conforming to a radius of said drum.

11. The metal extension of claim 1 whereby the shape of said extension conforms to a radius of said drum.

12. The metal extension of claim 1 whereby said extension extends axially outward from an edge of said drum.

13. The antenna assembly of claim 1 further comprising a reflector to reflect electromagnetic signals that are evanescently coupled with said dielectric waveguide.

14. An input signal coupler for matching electromagnetic characteristics of a feeding waveguide to a dielectric waveguide in a drum millimeter waveguide antenna assembly comprising:

a horn-shaped element having an axial opening therethrough to receive said dielectric waveguide; and a metal extension abutting said drum and in proximal relationship with said horn-shaped element said extension operating to reduce scattering of electromagnetic energy from the edges of said drum.

15. The dielectric waveguide of claim 14 wherein said waveguide is a single-mode waveguide.

16. The dielectric waveguide of claim 14 wherein said dielectric is selected from the group consisting of ceramics, quartz and Teflon.

17. The dielectric waveguide of claim 14 wherein said waveguide is fabricated as a circular rod.

18. The dielectric waveguide of claim 14 wherein said waveguide is fabricated as a rectangular rod.

19. The dielectric waveguide of claim 14 wherein said waveguide conducts millimeter wavelength electromagnetic waves.

20. The horn-shaped element of claim 14 wherein said horn-shaped element is made of metal.

21. The horn-shaped element of claim 14 wherein said horn-shaped element is conical in shape.

22. The horn-shaped element of claim 14 wherein said horn-shaped element has a peripheral cutout out conforming to a radius of said drum.

23. The metal extension of claim 14 whereby the shape of said extension conforms to a radius of said drum.

24. The metal extension of claim 14 whereby said extension extends axially outward from an edge of said drum.

25. The antenna assembly of claim 14 further comprising a reflector to reflect electromagnetic signals that are evanescently coupled with said dielectric waveguide.

26. A reflector for a drum millimeter waveguide antenna assembly said assembly comprising a dielectric waveguide and an input signal coupler having a horn-shaped element with an axial opening therethrough to receive said dielectric waveguide and a metal extention in proximal relationship with said horn-shaped element whereby said reflectors directs the propagation of evanescently coupled energy radiated by said antenna assembly.

27. The reflector of claim 26 wherein said reflector is made of metal.

28. The reflector of claim 26, said reflector having a parabolic shape with a focus line in close proximity to said dielectric waveguide to direct the vertical propagation of radiation from said antenna assembly.

29. The reflector of claim 26, said reflector having a surface shaped to form said radiated energy in a vertical plane.

30. The reflector of claim 26 wherein said reflector is a lens.

31. The lens of claim 30 wherein said lens is cylindrical.

32. The lens of claim 30 wherein said lens is semi-cylindrical.

33. The lens of claim 30 wherein said lens is a tapered cylindrical lens configured to alter the shape of radiated energy in a horizontal plane.

34. The lens of claim 30 wherein said lens is made of material from the group consisting of Teflon, polystyrene and polyethylene.

35. A method of matching the electromagnetic characteristics of a feeding waveguide to a dielectric waveguide in an antenna assembly comprising the steps of:

providing an input signal coupler to couple said feeding waveguide to said dielectric waveguide; and providing a horn-shaped element in said signal coupler said element having an axial opening therethrough to receive said dielectric waveguide and a metal extention in proximal relationship with said horn-shaped element whereby the electromagnetic properties of said horn-shaped element are chosen to lower the VSWR and return losses of said signal coupler.

* * * * *